US011326291B2

(12) United States Patent
Park et al.

(10) Patent No.: US 11,326,291 B2
(45) Date of Patent: May 10, 2022

(54) APPARATUS AND METHOD FOR PREDICTING FREEZING OF WASHING MACHINE

(71) Applicant: LG ELECTRONICS INC., Seoul (KR)

(72) Inventors: Hyun Ji Park, Seoul (KR); Seung Chul Cha, Suwon-si (KR); Sang Hyun Lee, Seoul (KR); Bon Kwon Koo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 319 days.

(21) Appl. No.: 16/678,957

(22) Filed: Nov. 8, 2019

(65) Prior Publication Data

US 2021/0087732 A1 Mar. 25, 2021

(30) Foreign Application Priority Data

Sep. 23, 2019 (KR) ..... 10-2019-0116665

(51) Int. Cl.
*D06F 33/00* (2020.01)
*D06F 37/42* (2006.01)
(Continued)

(52) U.S. Cl.
CPC ..... *D06F 33/00* (2013.01); *D06F 37/42* (2013.01); *D06F 39/04* (2013.01); *D06F 2103/32* (2020.02)

(58) Field of Classification Search
None
See application file for complete search history.

(56) References Cited

U.S. PATENT DOCUMENTS 5,701,624 A * 12/1997 Shin ..... D06F 33/36 8/159
2013/0239336 A1* 9/2013 Kim ..... D06F 33/34 8/137
2018/0305851 A1* 10/2018 Kwon ..... D06F 34/05

FOREIGN PATENT DOCUMENTS

KR 10-2005-0050302 A 5/2005
KR 10-0762266 B1 10/2007

OTHER PUBLICATIONS

Espacenet translation KR 10-0762266 Washing machine and method for preventing freezing, Jang, Samsung (Year: 2007).*

* cited by examiner

*Primary Examiner* — Cristi J Tate-Sims
(74) *Attorney, Agent, or Firm* — Birch, Stewart, Kolasch & Birch, LLP

(57) ABSTRACT

An apparatus and a method for predicting freezing of a washing machine, which predicts freezing of the washing machine based on a change of air temperature through an artificial intelligence algorithm and provides a freeze prediction result to a user terminal associated with the washing machine in a 5G environment, thereby preventing freezing of the washing machine. The apparatus for predicting freezing of the washing machine determines, based on temperature data sensed by a temperature sensor disposed in the washing machine and air temperature data received from a meteorological administration server, an association of temperature change of the washing machine according to the air temperature data, through the freezing prediction algorithm, and predicts freezing of the washing machine based on the association of temperature change of the washing machine and an air temperature forecast received from the meteorological administration server.

18 Claims, 9 Drawing Sheets

(51) Int. Cl.
*D06F 39/04* (2006.01)
*D06F 103/32* (2020.01)

APPARATUS AND METHOD FOR PREDICTING FREEZING OF WASHING MACHINE

CROSS-REFERENCE TO RELATED APPLICATION

This present application claims benefit of priority to Korean Patent Application No. 10-2019-0116665, entitled "APPARATUS AND METHOD FOR PREDICTING FREEZING OF WASHING MACHINE," filed on Sep. 23, 2019, in the Korean Intellectual Property Office, the entire disclosure of which is incorporated herein by reference.

BACKGROUND

1. Technical Field

The present disclosure relates to an apparatus and a method for predicting freezing of a washing machine, which may predict freezing of the washing machine based on a change of air temperature and provide a freeze prediction result to a user terminal associated with the washing machine, thereby preventing freezing of the washing machine.

2. Description of the Related Art

In general, a washing machine (for example, a drum washing machine) is an apparatus that allows washing to be performed by a force that pulls up laundry therein and then drops it when a cylindrical rotating drum rotates. Such a washing machine has a longer washing time than a conventional pulsator type of washing machine, but the demand for such a washing machine is increasing due to less damage to fabric and less water consumption.

Such a washing machine supplies water into a water tub for washing and rinsing and performs a washing operation through a series of water supply or drainage operations of draining the water in the water tub after the washing and rinsing.

However, in the current washing machine, due to its structure, after completion of the washing, a significant amount of water (hereinafter referred to as residual water) remains in the water tub, a water supply path (a water supply device including a water supply valve, a water supply pipe, or the like), a drainage path (drain device including a drain pump, drain pipe, or the like), and the like.

As such, although residual water in the washing machine remaining in the water tub, the water supply path, and the drainage path is not normally a problem, such residual water is frozen in the winter season, making it difficult for the washing machine to work properly, and if a user continues to operate the washing machine without knowing this, due to excessive operation, not only does failure of the washing machine occur, but the life of the washing machine is also shortened.

As a method for preventing this, related art 1 discloses a method for thawing residual water in a drain hose for a drum washing machine. In the above-mentioned method, it is possible to prevent poor drainage due to freezing of wash water in the drain hose by using an electro-thermal heater installed outside the drain pipe of the drum washing machine.

Also, related art 2 discloses a method of preventing freezing of a flow path inside a washing machine. In the above-mentioned method, after washing is finished, a surrounding temperature of the washing machine or a change in the surrounding temperature is sensed, and when the sensed temperature is a temperature at which freezing may occur, a certain amount of water flows into a water supply path and a drainage path, thereby preventing freezing of the flow path inside the washing machine.

In related art 1, when it is determined that the residual water in the washing machine is frozen in the drain hose, it is possible to thaw the residual water by supplying power to the electro-thermal heater installed on an outer circumferential surface of the drain hose. However, related art 1 does not prevent the shortcoming of freezing the residual water in advance.

In related art 2, after the washing is finished, when the surrounding temperature is the temperature at which freezing may occur, it is possible to prevent freezing of the flow path in the washing machine by carrying out an operation of causing the certain amount of water to flow into the water supply path and the drainage path. However, in related art 2, the temperature must be checked periodically, and when the temperature at which freezing may occur persists, the operation must be continued, and the washing machine must thus be powered on continuously. As such, related art 2 is capable of preventing freezing of the flow path in the washing machine only when the washing machine is powered on, and causes unnecessary costs due to keeping the washing machine powered on and using the water according to the performance of the operation.

Therefore, regardless of the power supply state of the washing machine, there is a need for a technology that is capable of preventing freezing of the washing machine in advance, thereby reducing unnecessary costs.

RELATED ART DOCUMENTS

Patent Documents

Related Art 1: Korean Patent Application Publication No. 10-2005-0050302

Related Art 2: Korean Patent Registration No. 10-0762266

SUMMARY OF THE INVENTION

The present disclosure is directed to predicting freezing of a washing machine based on a change of air temperature, and providing freeze protection guide information on the washing machine to a user terminal associated with the washing machine when it is predicted that the washing machine will be frozen, thereby enabling actions to be taken to prevent freezing of the washing machine.

The present disclosure is further directed to determining, based on temperature data (for example, temperature data sensed by a temperature sensor before a washing operation starts, or temperature data periodically sensed by the temperature sensor when the washing operation is not performed) received from the washing machine for a predetermined period of time while the washing machine is powered on and air temperature data received from a meteorological administration server for the predetermined period of time, an association of temperature change of the washing machine according to the air temperature data, thereby predicting freezing of the washing machine based on the association and an air temperature forecast received from the meteorological administration server even when the washing machine is powered off.

Also, the present disclosure is further directed to quickly and accurately predicting freezing of the washing machine by using a pre-trained freezing prediction algorithm of the washing machine, when predicting freezing of the washing machine.

According to one embodiment of the present disclosure, an apparatus for predicting freezing of a washing machine according to a change of air temperature may include: a memory in which a freezing prediction algorithm of the washing machine is stored, and one or more processors in communication with the memory, the one or more processors being configured to: determine, based on temperature data sensed by a temperature sensor disposed in the washing machine and air temperature data received from a server, an association of temperature change of the washing machine according to the air temperature data, through the freezing prediction algorithm; and predict freezing of the washing machine based on the association of temperature change of the washing machine and an air temperature forecast received from the meteorological administration server.

According to this embodiment of the present disclosure, the temperature data may be measured after the washing machine is powered on and before a washing operation starts for a predetermined period of time after the washing machine is installed.

According to this embodiment of the present disclosure, the freezing prediction algorithm may be a neural network model that is trained to determine a group to which the washing machine belongs, based on the air temperature data collected from the server and the temperature change of the washing machine according to the air temperature data, wherein the group is one of a freeze washing machine group in which freezing occurred within a predetermined collection period of time and a non-freeze washing machine group in which freezing did not occur within the predetermined collection period of time. Also, the neural network model may be trained to use, as training data, the temperature data measured for the predetermined collection period of time in another washing machine of a freeze washing machine group in which freezing occurred within the predetermined collection period of time, temperature data measured for the predetermined collection period of time in another washing machine of a non-freeze washing machine group in which freezing did not occur within the predetermined collection period of time, and air temperature information collected from the server for the predetermined collection period of time, and to determine whether the washing machine belongs to the freeze washing machine group or the non-freeze washing machine group, based on the training data.

According to this embodiment of the present disclosure, the one or more processors may be further configured to receive, from the washing machine, temperature data for a predetermined period of time, receive, from the server, air temperature data for the predetermined period of time, and apply the freezing prediction algorithm to the received temperature data and air temperature data for the predetermined period of time to determine the association of temperature change of the washing machine.

According to this embodiment of the present disclosure, the one or more processors may be configured to determine whether a location of the washing machine is indoors or outdoors, based on the association of temperature change of the washing machine, and wherein the predicting of the freezing of the washing machine occurs when the washing machine is determined to be located outdoors.

According to this embodiment of the present disclosure, the one or more processors may be further configured to apply the freezing prediction algorithm to the temperature data and the air temperature data, determine a group to which the washing machine belongs, from among a freeze washing machine group or a non-freeze washing machine group based on the air temperature forecast, and predict when the washing machine will be frozen when the determined group is the freeze washing machine group.

According to this embodiment of the present disclosure, the one or more processors may be further configured to provide a freeze protection guide information of the washing machine to a user terminal associated with the washing machine when the prediction of when the washing machine will be frozen occurs.

According to this embodiment of the present disclosure, the one or more processors may be further configured to further provide an execution query message regarding a freeze protection function in the washing machine to the user terminal, together with the freeze protection guide information of the washing machine, and cause the washing machine to execute the freeze protection function when an execution instruction regarding the freeze protection function is received from the user terminal.

According to this embodiment of the present disclosure, the one or more processors may be further configured to determine whether there is a date in the air temperature forecast on which the air temperature is predicted to be equal to or less than a predetermined freezing temperature, and predict that the washing machine will be frozen when the date is determined.

According to this embodiment of the present disclosure, the one or more processors may be further configured to select, as a freezing prediction time of the washing machine, the date on which the air temperature is predicted to be equal to or less than the predetermined freezing temperature, when the prediction of when the machine will be frozen occurs, and provide a freeze protection guide information on the washing machine to the user terminal associated with the washing machine a predetermined period of time before the selected freezing prediction time.

According to this embodiment of the present disclosure, the one or more processors may be further configured to provide freeze protection guide information of the washing machine to a user terminal associated with the washing machine before the predetermined time based on the freezing prediction time of the washing machine at which freezing of the washing machine is predicted, and when usage information of the washing machine is determined from the washing machine, change a provision time of the freeze protection guide information on the washing machine by adjusting the predetermined time based on the usage information of the washing machine.

According to one embodiment of the present disclosure, a method for predicting freezing of a washing machine according to a change of air temperature may include: storing a freezing prediction algorithm of the washing machine in a memory; receiving, from the washing machine, temperature data sensed by a temperature sensor disposed in the washing machine, receiving air temperature data from a server, and determining, based on the received temperature data and the received air temperature data, an association of temperature change of the washing machine according to the air temperature data through the freezing prediction algorithm; and predicting freezing of the washing machine based on the association of temperature change of the washing machine and an air temperature forecast received from the server.

According to this embodiment of the present disclosure, the temperature data may be measured after the washing machine is powered on and before a washing operation starts for a predetermined period of time.

According to this embodiment of the present disclosure, the freezing prediction algorithm may be a neural network model that is trained to determine a group to which the washing machine belongs, based on the air temperature data collected from the server and the temperature change of the washing machine according to the air temperature data, wherein the group is one of a freeze washing machine group in which freezing occurred within a predetermined collection period of time and a non-freeze washing machine group in which freezing did not occur within the predetermined collection period of time. Also, the neural network model may be trained to use, as training data, temperature data measured for a predetermined collection period of time in another washing machine of a freeze washing machine group in which freezing occurred within the predetermined collection period of time, temperature data measured for the predetermined collection period of time in another washing machine of a non-freeze washing machine group in which freezing did not occur within the predetermined collection period of time, and air temperature information collected from the server for the predetermined collection period of time, and to determine whether the washing machine belongs to the freeze washing machine group or the non-freeze washing machine group based on the training data.

According to this embodiment of the present disclosure, the determining the association of temperature change of the washing machine may comprise receiving, from the washing machine, the temperature data for a predetermined period of time, receiving, from the server, the air temperature data for the predetermined period of time, and applying the freezing prediction algorithm to the received temperature data and air temperature data for the predetermined period of time to determine the association of temperature change of the washing machine.

According to this embodiment of the present disclosure, the predicting freezing of the washing machine may comprise determining whether a location of the washing machine is indoors or outdoors, based on the association of temperature change of the washing machine, and predicting freezing of the washing machine when the washing machine is located outdoors.

According to this embodiment of the present disclosure, the predicting freezing of the washing machine may comprise applying the freezing prediction algorithm to the temperature data and the air temperature data, determining a group to which the washing machine belongs, from among a freeze washing machine group or a non-freeze washing machine group, based on the air temperature forecast, and predicting when the washing machine will be frozen when the determined group is the freeze washing machine group.

According to this embodiment of the present disclosure, the method may further comprise, after the predicting freezing of the washing machine, providing a freeze protection guide information of the washing machine to a user terminal associated with the washing machine when the prediction of when the washing machine will be frozen occurs.

According to this embodiment of the present disclosure, the predicting that the washing machine will be frozen may comprise determining whether there is a date in the air temperature forecast on which the air temperature is predicted to be equal to or less than a predetermined freezing temperature, and predicting that the washing machine will be frozen when the date is determined.

According to this embodiment of the present disclosure, the method may further comprise, after the predicting freezing of the washing machine, selecting, as a freezing prediction time of the washing machine, the date on which the air temperature is predicted to be equal to or less than the predetermined freezing temperature, when it is predicted that the washing machine will be frozen, and providing a freeze protection guide information of the washing machine to the user terminal associated with the washing machine a predetermined period of time before on the selected freezing prediction time.

In addition, other methods and other systems for implementing the present disclosure, and a computer-readable recording medium storing computer programs for executing the above methods may be further provided.

The above and other aspects, features, and advantages of the present disclosure will become apparent from the detailed description of the following aspects in conjunction with accompanying drawings.

According to embodiments of the present disclosure, freezing of a washing machine may be predicted based on a change of air temperature, and when it is predicted that the washing machine will be frozen, freeze protection guide information on the washing machine is provided to a user terminal associated with the washing machine, thereby enabling actions to be taken to prevent freezing of the washing machine.

According to embodiments of the present disclosure, an association of temperature change of the washing machine according to air temperature data may be determined based on temperature data (for example, temperature data sensed by a temperature sensor before the washing operation starts or temperature data periodically sensed by the temperature sensor when the washing operation is not performed) received from the washing machine for a predetermined period of time while the washing machine is powered on and the air temperature data received from a meteorological administration server for the predetermined period of time. As a result, it is possible to predict freezing of the washing machine based on the association and an air temperature forecast received from the meteorological administration server, even when the washing machine is powered off.

According to the embodiments of the present disclosure, it is possible to quickly and accurately predict freezing of the washing machine by using a pre-trained freezing prediction algorithm of the washing machine, when predicting freezing of the washing machine.

DETAILED DESCRIPTION OF THE INVENTION

Figure 1:
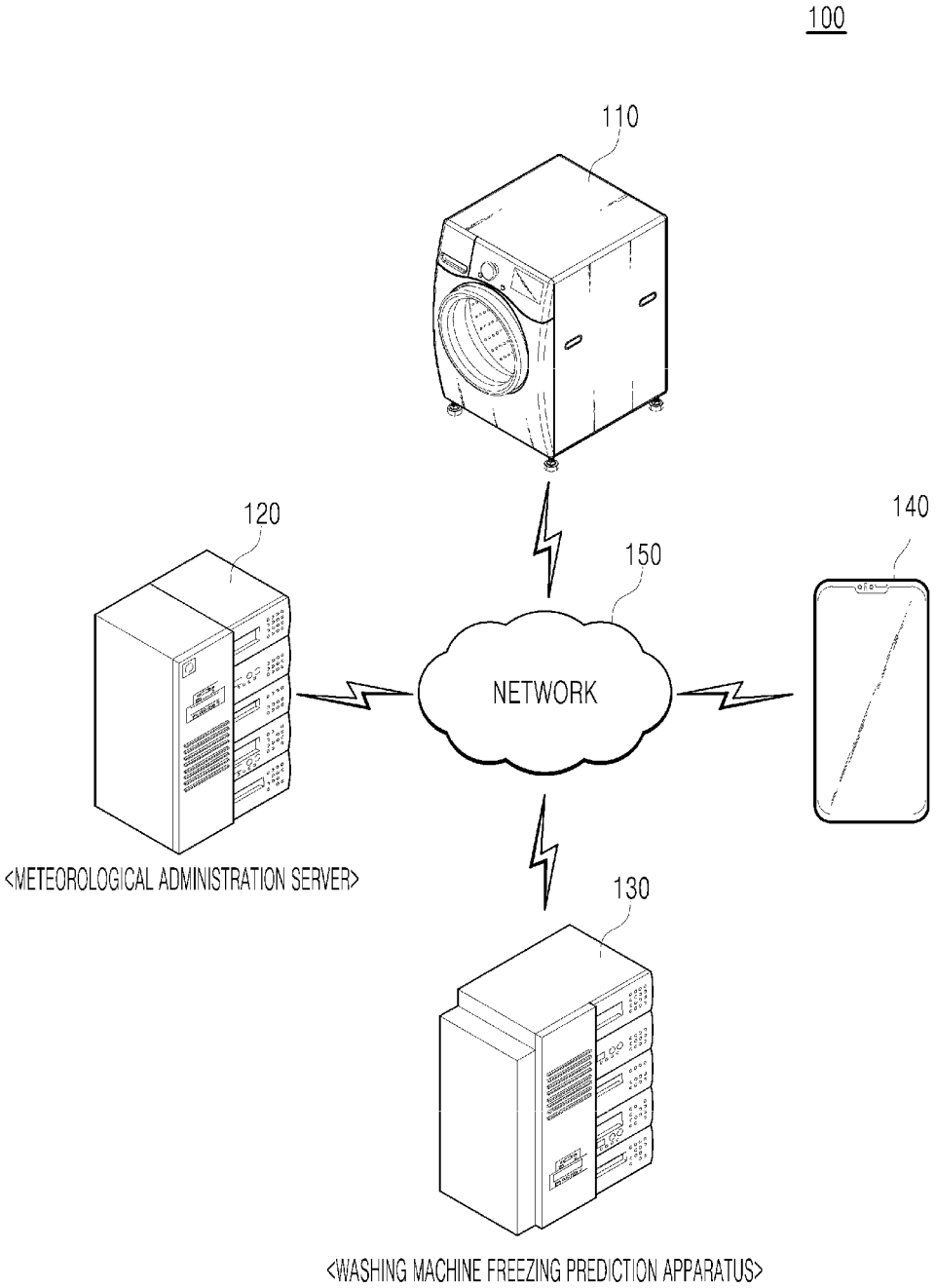
FIG. 1 is an exemplary diagram of a washing machine freezing prediction environment including a washing machine freezing prediction apparatus, a washing machine, a user terminal, and a network interconnecting them, according to one embodiment of the present disclosure.

Advantages and features of the present disclosure and methods of achieving the advantages and features will be more apparent with reference to the following detailed description of example embodiments in connection with the accompanying drawings. However, the present disclosure is not limited to the embodiments disclosed below but may be implemented in various different forms, and should be construed as including all modifications, equivalents, or alternatives that fall within the spirit and scope of the present disclosure. The example embodiments disclosed below are provided so that the present disclosure will be thorough and complete, and also to provide a more complete understanding of the scope of the present disclosure to those of ordinary skill in the art. In relation to describing the present disclosure, when the detailed description of the relevant known technology is determined to unnecessarily obscure the gist of the present disclosure, the detailed description may be omitted.

The terminology used herein is used for the purpose of describing particular embodiments merely and is not intended to limit the scope of the present disclosure. As used herein, the articles "a," "an," and "the," include plural referents unless the context clearly dictates otherwise. As used herein, it will be understood that terms such as "comprise," "include," "have," and the like are intended to specify the presence of stated feature, integer, step, operation, component, part or combination thereof, but do not preclude the presence or addition of one or more other features, integers, steps, operations, components, parts or combinations thereof. The terms such as "the first," "the second," and the like may be used in describing various components, but the above components shall not be restricted to the above terms. These terms are generally only used to distinguish one element from another.

In the following, the embodiments according to the present disclosure will be described in greater detail with reference to the accompanying drawings, and in the description with reference to the accompanying drawings, the identical or analogous components are designated by the same reference numeral, and repeated description thereof will be omitted.

FIG. 1 is an exemplary diagram of a washing machine freezing prediction environment including a washing machine freezing prediction apparatus, a washing machine, a user terminal, and a network interconnecting them, according to one embodiment of the present disclosure.

Referring to FIG. 1, the washing machine freezing prediction environment 100 may include a washing machine 110, a meteorological administration server 120, a washing machine freezing prediction apparatus 130, a user terminal 140, and a network 150.

The washing machine 110 is an apparatus configured to process laundry through various operations such as washing, spin-drying, and/or drying. The washing machine 110 may include a washing machine configured to remove contaminants from the laundry (hereinafter also referred to as "cloth") using water and detergent, a dehydrator configured to dehydrate laundry by rotating a drum loaded with the wet laundry at high speed, a dryer configured to dry the laundry by supplying dry air into the drum loaded with the laundry, a combined dryer and washing machine having both king function and washing function, and the like. Detailed structure of the washing machine 110 will be described later with reference to FIG. 2.

The washing machine 110 may generate temperature data by periodically measuring a temperature through a temperature sensor (for example, thermistor) disposed therein, and transmit the temperature data to the washing machine freezing prediction apparatus 130.

The meteorological administration server 120 may collect an air temperature forecast (for example, an outside air temperature for each region) at predetermined intervals. The meteorological administration server 120 may provide the air temperature forecast to the washing machine freezing prediction apparatus 130 in response to a request for the air temperature forecast from the washing machine freezing prediction apparatus 130.

The washing machine freezing prediction apparatus 130 may be, for example, an artificial intelligence (AI) server, and a database server that provides big data necessary for applying an artificial intelligence algorithm (for example, a freezing prediction algorithm of the washing machine) and a variety of service information based on the big data.

Here, artificial intelligence (AI) refers to afield of studying artificial intelligence or a methodology for creating the same. Moreover, machine learning refers to a field of defining various problems dealing in an artificial intelligence field and studying methodologies for solving the same. The machine learning may be defined as an algorithm for improving performance with respect to any task through repeated experience with respect to the task.

An artificial neural network (ANN) is a model used in machine learning, and may refer to in general a model with problem solving abilities, which consist of artificial neurons (nodes) forming a network by coupling synapses. The artificial neural network may be defined by a connection pattern between neurons on different layers, a learning process of updating model parameters, and an activation function of generating an output value.

The artificial neural network may include an input layer, an output layer, and optionally one or more hidden layers. Each layer may include one or more neurons, and the artificial neural network may include synapses that connect the neurons to one another. In the artificial neural network, each neuron may output a function value of the activation function with respect to input signals inputted through the synapse, weight, and bias.

A model parameter refers to a parameter determined through learning, and may include weight of synapse connection, bias of a neuron, and the like. In addition, a hyperparameter refers to a parameter which is set before learning in the machine learning algorithm, and may include a learning rate, a number of repetitions, a mini batch size, an initialization function, and the like.

The objective of training an artificial neural network is to determine a model parameter for significantly reducing a loss function. The loss function may be used as an indicator for determining an optimal model parameter in a training process of an artificial neural network.

Machine learning may be classified into supervised learning, unsupervised learning, and reinforcement learning depending on the learning method.

Supervised learning may refer to a method for training the artificial neural network with training data that has been given a label. In addition, the label may refer to a target answer (or a result value) to be inferred by the artificial neural network when the training data is inputted to the artificial neural network. Unsupervised learning may refer to a method for training an artificial neural network with training data that has not been given the label. Reinforcement learning may refer a learning method for training an agent defined within any environment to select an action or an action order for maximizing cumulative rewards in each state.

Machine learning implemented as a deep neural network (DNN) including a plurality of hidden layers, among artificial neural networks may be referred to as deep learning, which is part of machine learning.

The washing machine freezing prediction apparatus 130, which is an artificial intelligence server, may use, as training data, temperature data from more than a predetermined number of washing machines and air temperature information collected from the meteorological administration server to train the freezing prediction algorithm of the washing machine through the deep learning. Also, the washing machine freezing prediction apparatus 130 may further use, as training data, usage information of the washing machine (for example, whether it is frozen, number of times it has been frozen, date it was frozen, frequency of use, pattern of use, date of use, or the like).

Thereafter, the washing machine freezing prediction apparatus 130 may receive the temperature data from the washing machine 110 while the washing machine is powered on for a predetermined period of time, receive the air temperature data from the meteorological administration server 120 for the predetermined period of time, and determine, based on the temperature data and the air temperature data, an association of temperature change of the washing machine according to the air temperature data through the freezing prediction algorithm stored in an internal memory. The washing machine freezing prediction apparatus 130 may further receive an air temperature forecast from the meteorological administration server 120, and predict freezing of the washing machine 110 according to the association and the air temperature forecast. In this case, the washing machine freezing prediction apparatus 130 may predict freezing of the washing machine according to the association and the air temperature forecast received from the meteorological administration server, by determining in advance the association of temperature change of the washing machine according to the air temperature data, even if the washing machine 110 is powered off.

The washing machine freezing prediction apparatus 130 may prevent the washing machine 110 from freezing, by providing freeze protection guide information on the washing machine 110 to the user terminal 140 associated with the washing machine 110, when it is predicted that the washing machine will be frozen.

The user terminal 140 is a terminal possessed by a user, and for example may be, but is not limited to, a smartphone, a notebook, a tablet PC, a smart TV, a mobile phone, a personal digital assistant (PDA), a laptop, a media player, an e-book terminal, a digital broadcasting terminal, a navigation, an MP3 player, a digital camera, home appliances, and any other mobile or immobile computing device. Also, the user terminal 140 may be a wearable terminal implemented with communication functionality and data processing functionality, such as a wearable watch, wearable glasses, a wearable hairband, a wearable ring, and the like. The user terminal 140 is not limited to the aforementioned items, but may be any terminal capable of web-browsing.

The network 150 may interconnect the washing machine 110, the meteorological administration server 120, the washing machine freezing prediction apparatus 130, and the user terminal 140. The network 150 may include, but is not limited to, wired networks such as local area networks (LANs), wide area networks (WANs), metropolitan area networks (MANs), and integrated service digital networks (ISDNs), or wireless networks such as wireless LANs, CDMA, Bluetooth, satellite communications, and the like. Also, the network 150 may transmit or receive data using short distance communication and/or long distance communication. Here, examples of the short distance communication may include Bluetooth, radio frequency identification (RFID), infrared data association (IrDA), ultra-wideband (UWB), ZigBee, and wireless fidelity (Wi-Fi) technologies. Also, examples of the long distance communication may include code division multiple access (CDMA), frequency division multiple access (FDMA), time division multiple access (TDMA), orthogonal frequency division multiple access (OFDMA), and single carrier frequency division multiple access (SC-FDMA) technologies.

The network 150 may include a connection of network elements such as hubs, bridges, routers, switches, and gateways. The network 150 may include one or more connected networks, including a public network such as the Internet and a private network such as a secure corporate private network. For example, the network may include a multi-network environment. Access to network 150 may be provided via one or more wired or wireless access networks. Furthermore, the network 150 may support 5G communication and/or an Internet of things (IoT) network to exchanging and processing information between distributed components such as objects.

Figure 2:
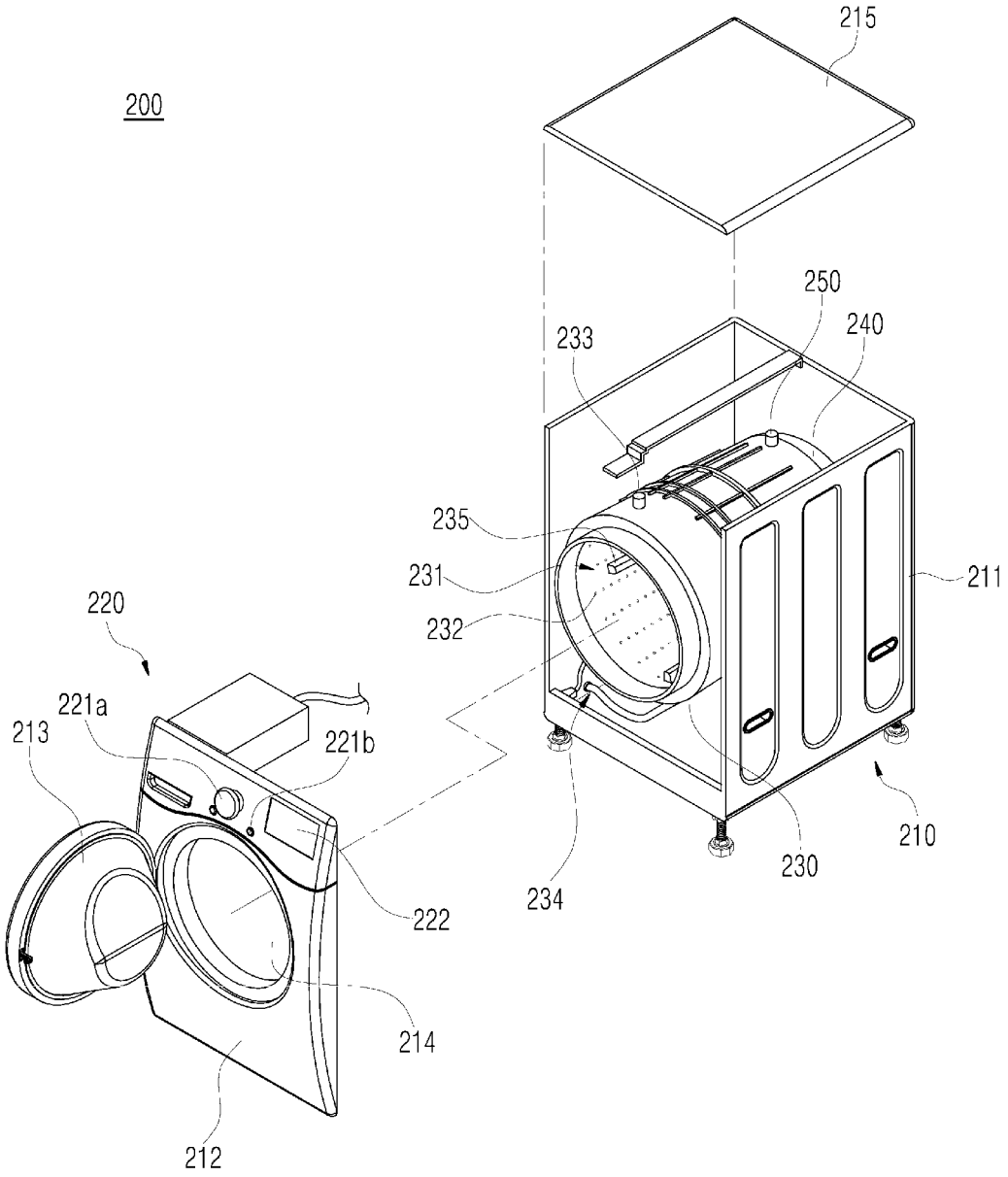
FIG. 2 is a diagram schematically illustrating a structure of a washing machine that is subject to freezing prediction in a washing machine freezing prediction apparatus according to one embodiment of the present disclosure.

FIG. 2 is a diagram schematically illustrating a structure of a washing machine that is subject to freezing prediction in a washing machine freezing prediction apparatus according to one embodiment of the present disclosure.

Referring to FIG. 2, a washing machine 200 may include a cabinet 210 forming an exterior, a tub 230 provided inside the cabinet 210 and supported by the cabinet 210, a drum 231 rotatably disposed inside the tub 230 and into which laundry is loaded, a driver 240 configured to rotate the drum by applying torque to the drum 231, a UI 220 configured to allow a user to select and execute a washing course, a sensing unit 250 configured to sense various information, and a temperature sensor configured to measure a temperature (not shown). In this case, the driver 240 may include, for example, a motor, and the UI 220 may include input interfaces 221*a* and 221*b* and an output interface 222.

Also, the cabinet 210 may include a main body 211, a cover 212 provided and coupled to the front surface of the main body 211, and a top plate 215 coupled to an upper portion of the main body 211. The cover 212 may include an opening 214 provided to enable loading and unloading of the laundry, and a door 213 that selectively opens and closes the opening 214. In addition, the drum 231 may be provided with a space for washing the laundry loaded therein, and may be rotated by receiving power from the driver 240. Also, the drum 231 may be provided with a plurality of through holes 232. Accordingly, wash water stored in the tub 230 may be introduced into the drum 231 through the through holes 232 and the wash water inside the drum 231 may flow into the tub 230. Therefore, when the drum 231 is rotated, the laundry loaded in the drum 231 may be decontaminated through rubbing process with the wash water stored in the tub 230. Meanwhile, the drum 231 may further include a lifter 235 configured to stir the laundry.

The UI 220 is configured to allow the user to input information related to washing (including the entire operation process of the washing machine) as well as to check the information related to washing. That is, the UI 220 is configured to interface with the user. Thus, the UI 220 may be configured to include input interfaces 221*a* and 221*b* for allowing the user to input a control instruction and an output interface 222 for displaying control information according to the control instruction. In addition, the UI 220 may include a control unit (not shown) configured to control driving of the washing machine 200, including the operation of the driver 240, according to the control instruction. In this embodiment, the UI 220 may refer to a control panel capable of input and output for the control of the washing machine 200. For this purpose, the UI 220 may be configured as a touch-sensitive display controller or various input/output controllers. As an example, the touch-sensitive display controller may provide an output interface and an input interface between the apparatus and the user. The touch-sensitive display controller may transmit and receive an electrical signal with the control unit. Also, the touch-sensitive display controller may display visual output to the user, and the visual output may include texts, graphics, images, videos, and combination thereof. The UI 220 may be, for example, any display member such as an organic light emitting display (OLED) capable of touch recognition, a liquid crystal display (LCD), or a light emitting display (LED).

That is, in this embodiment, the UI 220 may perform a function of the input interfaces 221*a* and 221*b* that receive a predetermined control instruction so that the user may control the overall operation of the washing machine 200. Also, the UI 220 may perform a function of the output interface 122 that may display an operating state of the washing machine 200 under the control of the control unit. In this embodiment, the UI 220 may display an operation mode setting and/or a recommendation result of the washing machine 200 in response to a type of load of the laundry in the washing machine 200. Also, the UI 220 may output content including a reason to change to the recommended course, a description of a situation in which cloth unwinding is inevitable due to UE occurrence, or the like.

Also, in this embodiment, the washing machine 200 may be provided with at least one water supply hose (not shown) configured to guide water supplied from an external water source, such as a faucet, to the tub 230, and a water inlet 233 to control the at least one water supply hose. In addition, the washing machine 200 may be provided with a dispenser (not shown) configured to supply additives such as detergent, fabric softener and the like, into the tub 230 or the drum 231. In the dispenser, the additives may be classified and accommodated according to their type. The dispenser may include a detergent container (not shown) configured to contain the detergent and a softener container (not shown) configured to contain the fabric softener. In addition, the washing machine 200 may be provided with water supply pipes (not shown) configured to selectively guide the water supplied through the water inlet 233 to each container of the dispenser. The water inlet 233 may include a water supply valve configured to control each of the water supply pipes, and the water supply pipes may include respective water supply pipes to supply water to the detergent container and the fabric softener container, respectively.

Meanwhile, a drain hose 234 may include a drainage hole (not shown) configured to discharge the water from the tub 230, and a pump (not shown) configured to pump the discharged water. The pump may selectively perform a function of transporting the discharged water into a drain pipe (not shown) and a function of transporting the discharged water into a circulation pipe (not shown). In this case, the water that is transported by the pump and guided along the circulation pipe may be referred to as circulating water. The pump may include an impeller (not shown) configured to transport water, a pump housing (not shown) in which the impeller is accommodated, and a pump motor (not shown) configured to rotate the impeller. In the pump housing, an inlet port (not shown) through which water is introduced, a drain discharge port (not shown) configured to discharge the water transported by the impeller into the drain pipe, and a circulating water discharge port (not shown) configured to discharge the water transported by the impeller into a circulation pipe may be formed. Here, the pump motor may be capable of forward/reverse rotation. That is, in this embodiment, the water may be discharged through the drain discharge port or discharged through the circulating water discharge port, according to the direction in which the impeller is rotated. This configuration may be implemented by appropriately designing a structure of the pump housing. Since this technique is well known, a detailed description thereof will be omitted.

Meanwhile, the pump is capable of varying a flow rate (or discharge water pressure), and for this purpose, the pump motor constituting the pump may be a variable speed motor capable of controlling the rotational speed. The pump motor is preferably a suitable BLDC motor (Brushless Direct Current Motor), but is not necessarily limited thereto. A driver for controlling the speed of motor may be further provided, and the driver may be an inverter driver. The inverter driver may convert AC power to DC power and input it to the motor at a desired frequency. Also, the pump motor may be controlled by the control unit, and the control unit may be configured to include a Proportional-Integral Controller (PI controller), a Proportional-Integral-Derivative Controller (PID controller) or the like. The controller may receive an output value (for example, output current) of the pump motor, and control the output value of the driver so that revolution per minute of the pump motor follows a predetermined target revolution per minute based the received value. Also, the control unit may control the overall operation of the washing machine as well as the pump motor.

Meanwhile, in this embodiment, the washing machine 200 may include at least one balancer (not shown), in the front of the tub 130, along the circumference of the inlet of the tub 130. The balancer is for reducing vibration of the tub 230 and is a weight having a predetermined weight, and may be provided in plurality. For example, the balancers may be provided at the bottom of the front of the tub 230 as well as both the left and right sides of the front of the tub 230.

The sensing unit 250 may be configured to include a motor driving current sensor and a drum rotational speed sensor. In addition, the sensing unit 250 may further include a sensor configured to sense chemicals remaining in the wash water, an olfactory sensor configured to sense contaminated laundry, and the like, among the sensors not shown. In addition, foreign matter or the like included in the laundry may be sensed through a reflected wave by a wave sensor (not shown). For example, when the laundry includes metal such as a coin or the like, the foreign matter such as a coin or the like may be sensed by using characteristics of the reflected wave of the wave sensor. The motor driving current sensor may sense a driving current of the motor, and the drum rotation speed sensor may sense the rotation speed of the drum and output sensing data based on sensing the type of laundry.

Figure 3:
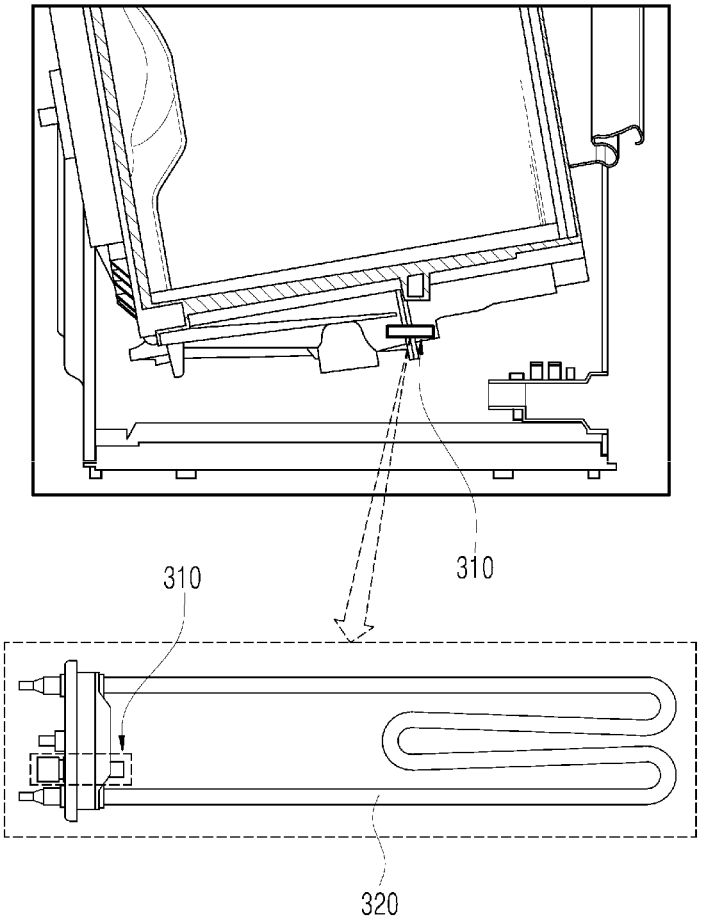
FIG. 3 is a diagram illustrating an arrangement structure of a temperature sensor in a washing machine that is subject to freezing prediction in a washing machine freezing prediction apparatus according to one embodiment of the present disclosure.

The temperature sensor may be, for example, a thermistor 310, and may be mounted to a heater 320 in the washing machine and positioned below the tub in the washing machine 200, as shown in FIG. 3. The temperature sensor may generate temperature data by sensing the temperature before a washing operation starts (for example, before water is supplied).

The washing machine 200 may transmit the temperature data to a washing machine freezing prediction apparatus via a transceiver (not shown) and may enable the transmitted data to be used as basic data, when the washing machine freezing prediction apparatus determines an association between the temperature data of the washing machine 200 and the air temperature data received from the meteorological administration server.

Figure 4:
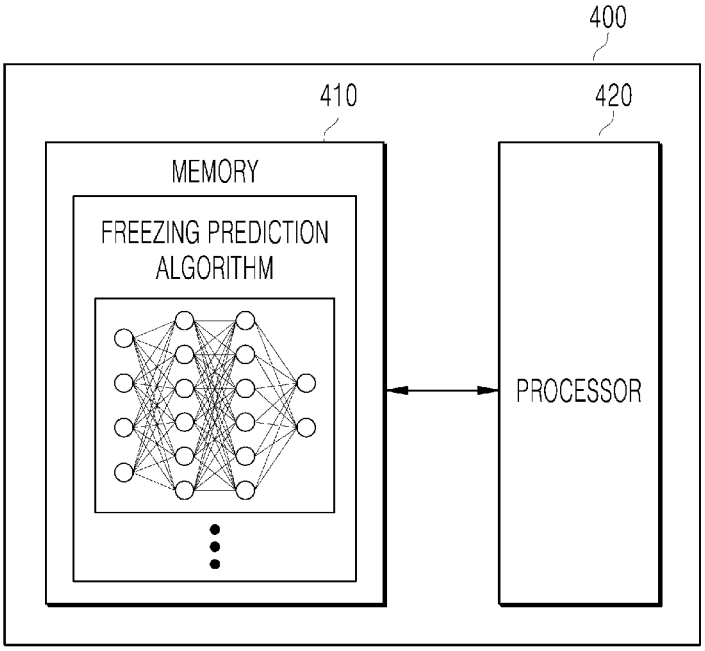
FIG. 4 is a diagram illustrating a configuration of a washing machine freezing prediction apparatus according to one embodiment of the present disclosure.

FIG. 4 is a diagram illustrating a configuration of a washing machine freezing prediction apparatus according to one embodiment of the present disclosure.

Referring to FIG. 4, a washing machine freezing predicting apparatus 400 according to one embodiment of the present disclosure is an apparatus for predicting freezing of the washing machine according to an air temperature change, and may include a memory 410 and one or more processors 420 communicating with the memory.

The memory 410 may store a freezing prediction algorithm of the washing machine.

The memory 410 may perform a function of temporarily or permanently storing data processed by the processor 420. Here, the memory 410 may include magnetic storage media or flash storage media, but the scope of the present disclosure is not limited thereto. The memory 410 may include an internal memory and/or an external memory and may include a volatile memory such as a DRAM, a SRAM or a SDRAM; a non-volatile memory such as one time programmable ROM (OTPROM), a PROM, an EPROM, an EEPROM, a mask ROM, a flash ROM, a NAND flash memory or a NOR flash memory; a flash drive such as an SSD, a compact flash (CF) card, an SD card, a Micro-SD card, a Mini-SD card, an XD card or memory stick; or a storage device such as a HDD.

The processor 420 may, (i) in a learning step, train the freezing prediction algorithm of the washing machine and store the trained freezing prediction algorithm in the memory 410. Here, the freezing prediction algorithm may be a neural network model that is trained to determine a group to which the washing machine belongs, based on the air temperature data collected from the meteorological administration server and a temperature change of the washing machine according to the air temperature data, wherein the group is one of a freeze washing machine group in which freezing occurred within a predetermined collection period of time and a non-freeze washing machine group in which freezing did not occur within the predetermined collection period of time.

Specifically, the processor 420 may first receive temperature data of the washing machine from more than a predetermined number of washing machines. Also, the processor 420 may further receive usage information of the washing machine (for example, whether it is frozen, number of times it has been frozen, date it was frozen, frequency of use, pattern of use, date of use, or the like). The processor may classify more than a predetermined number of washing machines into a freeze washing machine group in which freezing occurred within a predetermined collection period of time and a non-freeze washing machine group in which freezing did not occur within the collection period of time, based on the temperature data of the washing machine (or the temperature data and usage information of the washing machine). Subsequently, the processor 420 may train the neural network model to use, as training data, the temperature data (or the temperature data and usage information of the washing machine) measured for the collection period of time in the washing machine in the freeze washing machine group in which freezing occurred within the collection period of time, the temperature data (or the temperature data and usage information of the washing machine) measured for the collection period of time in the washing machine in the non-freeze washing machine group in which freezing did not occur within the collection period of time, and the air temperature information collected from the meteorological administration server for the collection period of time, and to determine whether the washing machine belongs to the freeze washing machine group or the non-freeze washing machine group, based on the temperature of the washing machine according to the air temperature information from the meteorological administration.

Subsequently, the processor 420 may, (ii) in an inferring step, determine a change in temperature difference (that is, an association of temperature change of the washing machine according to the air temperature data) between the temperature data for the washing machine (a specific washing machine) that is subject to freezing prediction and the air temperature from the meteorological administration, and may predict freezing of the washing machine based on the change in temperature difference and an air temperature forecast from the meteorological administration (for example, the air temperature for a week from the present date). In this case, the processor 420 may predict freezing of the washing machine based on the association and the air temperature forecast received from the meteorological administration server, by determining in advance the association of temperature change of the washing machine according to the air temperature data (for example, the degree of temperature change of the washing machine according to the change in external air temperature), even if the washing machine 110 is powered off.

Specifically, the processor 420 may determine, based on the temperature data sensed by the temperature sensor disposed in the washing machine and the air temperature data received from the meteorological administration server, the association of temperature change of the washing machine according to the air temperature data, through the freezing prediction algorithm stored in the memory 410. In this case, the processor 420 may receive, from the washing machine, the temperature data sensed by the temperature sensor in the washing machine for a predetermined period of time (for example, one year or a period of use), receive, from the meteorological administration server, the air temperature data for the predetermined period of time, and apply the freezing prediction algorithm to the received temperature data and air temperature data for the predetermined period to determine the association. Here, the temperature data may be temperature data that is measured after the washing machine is powered on and before a washing operation starts (or before water is supplied), for the predetermined period of time after the washing machine is installed, or temperature data periodically measured when the washing machine is powered on and the washing operation does not proceed.

Subsequently, the processor 420 may predict freezing of the washing machine based on the association of temperature change of the washing machine according to the air temperature data and the air temperature forecast received from the meteorological administration server (for example, air temperature in Seoul or air temperature in Daegwallyeong, for one week from the present date). Here, the air temperature forecast may not be specific to a particular region.

The processor 420 may check whether a location of the washing machine is indoors or outdoors based on the association of temperature change of the washing machine according to the air temperature data, and predict freezing of the washing machine when the washing machine is located outdoors as a result of the check.

When predicting freezing of the washing machine, the processor 420 may apply the freezing prediction algorithm to the temperature data sensed by the temperature sensor disposed in the washing machine and the air temperature data received from the meteorological administration server, and determine a group to which the washing machine belongs, from among the freeze washing machine group or the non-freeze washing machine group. Subsequently, the processor 420 may predict that the washing machine will be frozen when it is determined that the determined group is the freeze washing machine group, and that the washing machine in the freeze washing machine group will be frozen based on the air temperature forecast received from the meteorological administration server. In this case, the processor 420 may prevent freezing of the specific washing machine, by providing freeze protection guide information on the washing machine to a user terminal associated with the washing machine, when it is predicted that the washing machine will be frozen. That is, the processor 420 may provide customized information on the washing machine of the user, by providing the user terminal with the freezing prediction of the washing machine.

Here, the processor 420 may check whether there is a date in the air temperature forecast on which the air temperature is predicted to be equal to or less than a predetermined freezing temperature (or a predetermined cold wave temperature or the lowest air temperature for the predetermined period of time), and predict that the washing machine will be frozen when the date exists as a result of the check.

When it is predicted that the washing machine will be frozen, the processor 420 may be configured to select, as a freezing prediction time of the washing machine, the date on which the air temperature is predicted to be equal to or less than the predetermined freezing temperature, and provide freeze protection guide information on the washing machine to the user terminal associated with the washing machine a predetermined period of time (for example, two days) before the selected freezing prediction time. For example, when the freezing prediction time is two days after the present date, the processor 420 may provide the freeze protection guide information on the washing machine to the user terminal associated with the washing machine on the present date. Here, the freeze protection guidance information on the washing machine may be, for example, a message such as "The washing machine may freeze in two days (Dec. 26, 2019). Please remove residual water in the washing machine (for example, water remaining in the hose of the washing machine). Please refrain from using the washing machine for two days", or the like.

In this case, the processor 420 may change a provision time of the freeze protection guide information on the washing machine, by adjusting the predetermined period of time based on the usage information of the washing machine (for example, whether it is frozen, number of times it has been frozen, date it was frozen, frequency of use, pattern of use, date of use, or the like), when the usage information of the washing machine is received from the washing machine. Also, when predicting freezing of the washing machine, the processor 420 may further use the usage information of the washing machine, together with the association of temperature change of the washing machine according to the air temperature data and the air temperature forecast.

Meanwhile, when it is predicted that the washing machine will not be frozen, the processor 420 may provide non-freeze prediction result information on the washing machine to the user terminal, so that the user does not worry about freezing of the washing machine. Also, the processor 420 may not provide the non-freeze prediction result information on the washing machine to the user terminal, thereby limiting unnecessary provision of information.

Meanwhile, in providing the freeze protection guide information, the processor 420 may further provide an execution query message regarding a freeze protection function in the washing machine to the user terminal, together with the freeze protection guide information on the washing machine. In this case, the processor 420 may, when an execution instruction regarding the freeze protection function is received from the user terminal, cause the washing machine to execute the freeze protection function, thereby preventing freezing of the washing machine. That is, the processor 420 may transmit the execution instruction regarding the freeze protection function to the washing machine, and cause the washing machine to execute the freeze protection function. Here, the processor 420 may, when a response for the execution instruction regarding the freeze protection function is not received from the washing machine, transmit a state check request message of the washing machine (for example, "Please check if the washing machine is powered on. If the washing machine is powered off, please power it on", or the like) to the user terminal.

As another example, the processor 420 may predict freezing of the washing machine regardless of the location (indoors or outdoors) where the washing machine is present. Also, the processor 420 may provide the freeze protection guide information on the washing machine to the user terminal associated with the washing machine when it is predicted that the washing machine will be frozen even when the washing is located indoors.

As still another example, the processor 420 may predict freezing of the washing machine based on the location where the washing machine is present and the air temperature forecast received from the meteorological administration server. For example, the processor 420 may predict that the washing machine will be frozen when the washing machine is located outdoors and there is a date in the air temperature forecast on which the air temperature is predicted to be equal to or less than the predetermined freezing temperature. Meanwhile, the processor 420 may predict that the washing machine will not be frozen when the washing machine is located indoors, even when there is a date in the air temperature forecast on which the air temperature is predicted to be equal to or less than the predetermined freezing temperature.

Meanwhile, the processor 420 may be linked to washing machine installation to receive, from the washing machine or a manager terminal, regional information (for example, for Seoul, Changwon, or the like) indicating a region where the washing machine is installed, and store the installation region for each washing machine in the memory 410. Accordingly, when the region where the washing machine that is subjected to freezing prediction is installed is searched in the memory 410, when predicting freezing of the washing machine, the processor 420 may receive an air temperature forecast of the region where the washing machine is installed is received from the meteorological administration server, and predict freezing of the washing machine by applying the freezing prediction algorithm to the association of temperature change of the washing machine according to the air temperature data and the air temperature forecast of the region where the washing machine is installed.

Figure 5:
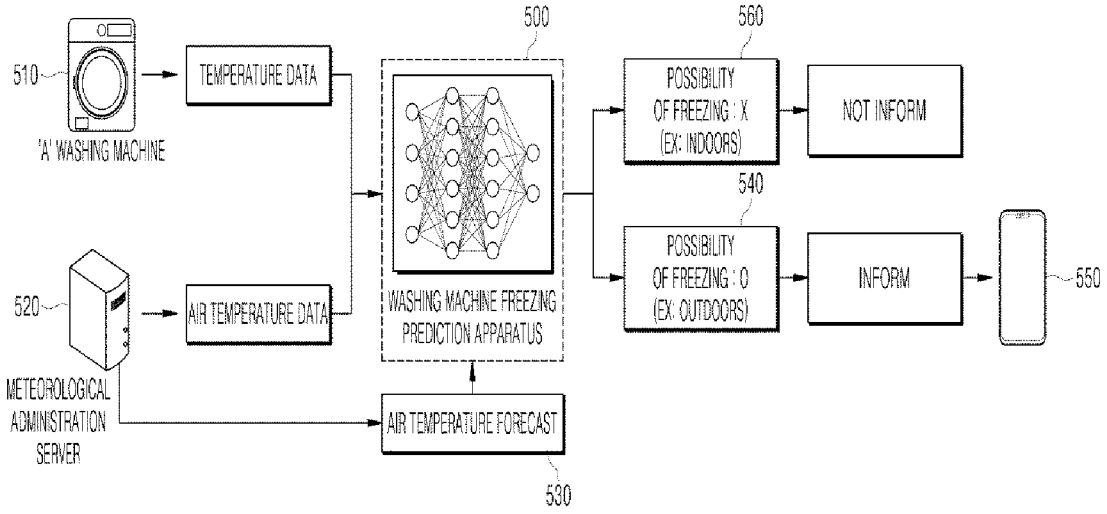
FIG. 5 is a diagram illustrating a process of predicting freezing of a washing machine in a washing machine freezing prediction apparatus according to one embodiment of the present disclosure.

FIG. 5 is a diagram illustrating a process of predicting freezing of a washing machine in a washing machine freezing prediction apparatus according to one embodiment of the present disclosure.

Referring to FIG. 5, a processor in the washing machine freezing prediction apparatus 500 may receive temperature data from an 'A' washing machine 510 for a predetermined period of time, for example, one year (from Jan. 1, 2018 to Dec. 31, 2018), and receive air temperature data from a meteorological administration server 520 for the predetermined period of time, for example, one year (from Jan. 1, 2018 to Dec. 31, 2018). The processor in the washing machine freezing prediction apparatus 500 may determine a group to which the 'A' washing machine 510 belongs, by applying a freezing prediction algorithm to the temperature data and the air temperature data. The processor in the washing machine freezing prediction apparatus 500 may predict that the 'A' washing machine 510 will be frozen when the determined group is the freeze washing machine group and when it is determined that the washing machine in the freeze washing machine group will be frozen based on the air temperature forecast 530 (for example, the air temperature forecast from Jan. 1, 2019 to Jan. 7, 2019) received from a meteorological administration server 520 (for example, when an air temperature of less than the predetermined freezing temperature is included in the air temperature forecast).

The processor in the washing machine freezing prediction apparatus 500 may inform a user terminal 550 associated with the 'A' washing machine 510 of a freeze prediction result when it is predicted that the 'A' washing machine will be frozen (when there is a possibility of freezing) 540. That is, the processor in the washing machine freezing prediction apparatus 500 may prevent the washing machine from freezing by providing freeze protection guide information on the washing machine to a user terminal 550 associated with the 'A' washing machine 510, when it is predicted that the 'A' washing machine 510 will be frozen.

Meanwhile, the processor in the washing machine freezing prediction apparatus 500 may not inform the user terminal 550 associated with the 'A' washing machine 510 of non-freeze prediction result information, when it is predicted that the 'A' washing machine 510 will not be frozen (when there is no possibility of freezing) 560. That is, the processor in the washing machine freezing prediction apparatus 500 may limit the provision of unnecessary information to the user terminal 550 when it is predicted that the 'A' washing machine 510 will not freeze.

Figure 6:
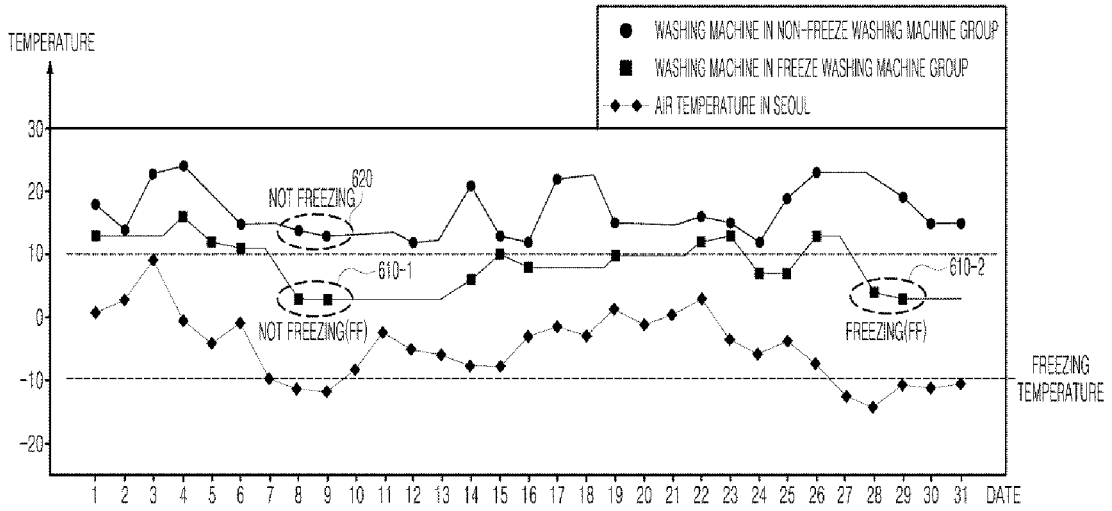
FIG. 6 is a diagram illustrating a specific example of predicting freezing of a washing machine in a washing machine freezing prediction apparatus according to one embodiment of the present disclosure.

FIG. 6 is a diagram illustrating a specific example of predicting freezing of a washing machine in a washing machine freezing prediction apparatus according to one embodiment of the present disclosure.

Referring to FIG. 6, a processor in the washing machine freezing prediction apparatus may receive washing machine temperature data from more than a predetermined number (for example, 60,000) of washing machines. Also, the processor may further receive usage information of the washing machine (for example, temperature data of the washing machine, whether it is frozen, number of times it has been frozen, date it was frozen, frequency of use, pattern of use, date of use, or the like). The processor in the washing machine freezing prediction apparatus may classify more than the predetermined number of washing machines into a freeze washing machine group in which freezing occurred within a collection period of time (for example, from Jan. 1, 2017 to Dec. 31, 2018) and a non-freeze washing machine group in which freezing did not occur within the collection period of time, based on the temperature data of the washing machine (or the temperature data and usage information of the washing machine). Here, the freeze washing machine group may be, for example, a group including washing machines 610-1 and 610-2 in which freezing occurred at a temperature equal to or less than a predetermined freezing temperature (or a predetermined cold wave temperature or the lowest air temperature for the predetermined period of time) (for example, −10° C. in Seoul). Also, the non-freeze washing machine group may be a group including a washing machine 620 in which freezing did not occur at a temperature equal to or less than the predetermined freezing temperature (or the lowest air temperature) (for example, −10° C. in Seoul).

The processor in the washing machine freezing prediction apparatus may train the freezing prediction algorithm to use, as training data, the temperature data measured for the collection period of time in all washing machines in the freeze washing machine group in which freezing occurred within the collection period of time, the temperature data measured for the collection period of time in all washing machines in the non-freeze washing machine group in which freezing did not occur within the collection period of time, and air temperature information collected from the meteorological administration server for the collection period of time, and to determine whether the washing machine belongs to the freeze washing machine group or the non-freeze washing machine group, based on the temperature of the washing machine according to the air temperature information from the meteorological administration.

Thereafter, the processor in the washing machine freezing prediction apparatus may predict freezing of the 'A' washing machine by using the freezing prediction algorithm of the washing machine.

Specifically, the processor in the washing machine freezing prediction apparatus may be apply the freezing prediction algorithm to the temperature data received from the 'A' washing machine and the air temperature data received from the meteorological administration server for the predetermined period of time (for example, from Jan. 1 to Dec. 31, 2018). In this case, the processor in the washing machine freezing prediction apparatus may determine an association of temperature change of the washing machine according to the air temperature data and a group (for example, either the freeze washing machine group or the non-freeze washing machine group) to which the 'A' washing machine belongs according to the association, by applying the freezing prediction algorithm.

The processor in the washing machine freezing prediction apparatus may receive, for example, the air temperature forecast for a week (from Dec. 23 to Dec. 30, 2019) from the meteorological administration server. Also, the processor may select Dec. 26, 2019 as the freezing prediction time for the 'A' washing machine when the group to which the 'A' washing machine belongs is the freeze washing machine group and when the air temperature on Dec. 26, 2019 in the air temperature forecast is equal to or less than the predetermined freezing temperature (for example, −10° C. in Seoul), and provide freeze protection guide information on the washing machine to the user terminal associated with the 'A' washing machine a predetermined period of time (for example, two days) before the freezing prediction time, that is, on Dec. 24, 2019. In this case, the washing machine freezing prediction apparatus may provide the freeze protection guide information by various methods (for example, a text message, an email, an application, or the like).

Also, the processor in the washing machine freezing prediction apparatus may receive usage information of the 'A' washing machine when the temperature data is received from the 'A' washing machine for the predetermined period of time (for example, from Jan. 1 to Dec. 31, 2018). The processor in the washing machine freezing prediction apparatus may change the provision time of the freeze protection guide information on the 'A' washing machine, by adjusting the predetermined period of time based on the usage information of the 'A' washing machine (for example, whether the washing machine is frozen, number of times it has been frozen, date it was frozen, frequency of use, pattern of use, or the like). For example, the processor in the washing machine freezing prediction apparatus may increase the predetermined period of time as the possibility of freezing of the washing machine becomes higher as the frequency of use of the 'A' washing machine is lower. That is, when the 'A' washing machine is used once a week, the processor in the washing machine freezing prediction apparatus may, for example, increase the predetermined period of time from two days to four days, and provide the freeze protection guide information on the washing machine to the user terminal associated with the 'A' washing machine on Dec. 22, 2019.

Figure 7:
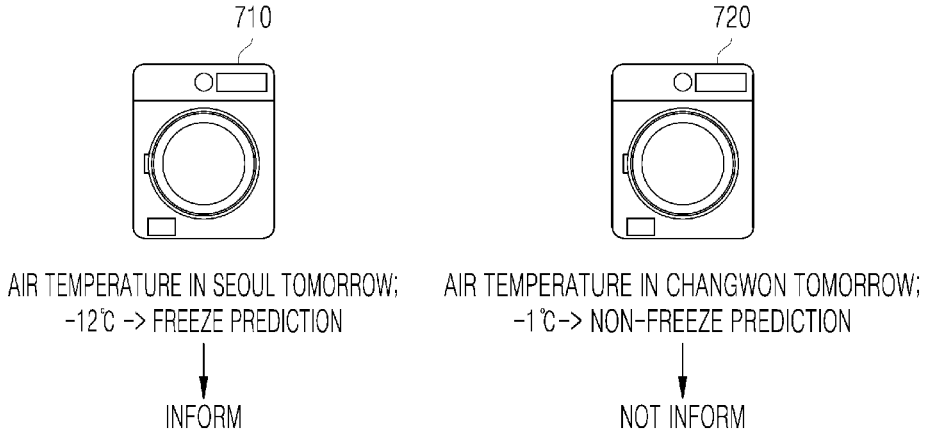
FIG. 7 is a diagram illustrating an example of washing machine freezing prediction for a washing machine for each region, in a washing machine freezing prediction apparatus according to one embodiment of the present disclosure.

FIG. 7 is a diagram illustrating an example of washing machine freezing prediction for a washing machine for each region, in a washing machine freezing prediction apparatus according to one embodiment of the present disclosure Referring to FIG. 7, a processor in the washing machine freezing prediction apparatus may linked to washing machine installation to receive, from the washing machine or a manager terminal, regional information indicating a region where the washing machine is installed.

The processor in the washing machine freezing prediction apparatus may, for example, apply a freezing prediction algorithm of the washing machine to temperature data received from a 'B' washing machine 710 installed in Seoul and air temperature data received from a meteorological administration server (for example, air temperature data that is not specific to a particular region'). In this case, the processor in the washing machine freezing prediction apparatus may determine an association of temperature change of the washing machine according to the air temperature data and a group (for example, either a freeze washing machine group or a non-freeze washing machine group) to which the 'B' washing machine 710 belongs according to the association, by applying the freezing prediction algorithm.

Subsequently, the processor in the washing machine freezing prediction apparatus may receive, for example, an air temperature forecast in Seoul for tomorrow from the meteorological administration server. Also, the processor may predict that the 'B' washing machine 710 will be frozen when the group to which the 'B' washing machine 710 belongs is the freeze washing machine group and when the air temperature forecast for Seoul for tomorrow is −12° C., which is lower than the predetermined freezing temperature (for example −10° C.), and provide freeze protection guide information on the 'B' washing machine to a user terminal associated with the B 'washing machine 710.

Meanwhile, the processor in the washing machine freezing prediction apparatus may, apply the freezing prediction algorithm of the washing machine to temperature data received from a 'C' washing machine 720 installed in Changwon and air temperature data received from the meteorological administration server (for example, air temperature data that is not specific to a particular region). In this case, the processor in the washing machine freezing prediction apparatus may determine an association of temperature change of the washing machine according to the air temperature data and the group (for example, either the freeze washing machine group or the non-freeze washing machine group) to which the 'C' washing machine 720 belongs according to the association, by applying the freezing prediction algorithm.

Subsequently, the processor in the washing machine freezing prediction apparatus may receive, for example, an air temperature forecast for Changwon for tomorrow from the meteorological administration server. Also, the processor may predict that the 'C' washing machine 720 will not freeze when the group to which the 'C' washing machine 720 belongs is not the freeze washing machine group, or when the air temperature forecast for Changwon for tomorrow is −1° C., which is higher than the predetermined freezing temperature (for example, −10° C.), even when the group to which the 'C' washing machine 720 belongs is the freeze washing machine group, and provide freeze prediction result information on the 'C' washing machine 720 to a user terminal associated with the 'C' washing machine 720 or limit provision of non-freeze prediction result information on the 'C' washing machine 720.

Figure 8:
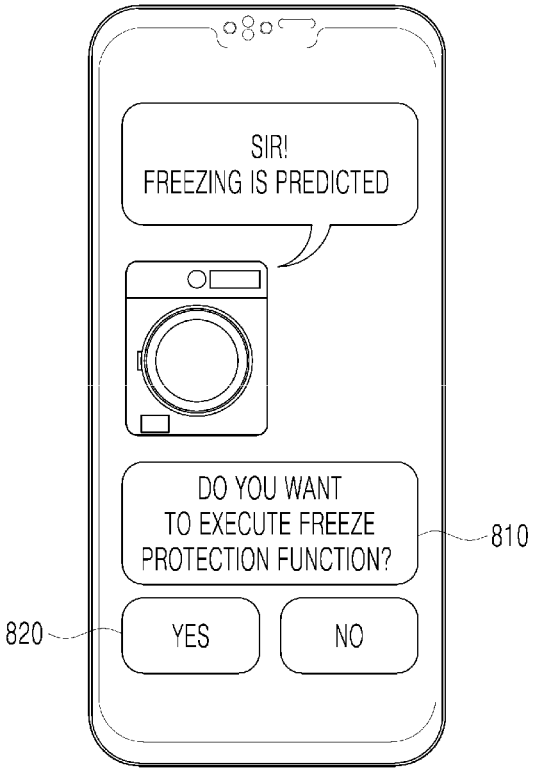
FIG. 8 is a diagram illustrating an example of supporting a freeze protection function of a washing machine in a washing machine freezing prediction apparatus according to one embodiment of the present disclosure.

FIG. 8 is a diagram illustrating an example of supporting a freeze protection function of a washing machine in a washing machine freezing prediction apparatus according to one embodiment of the present disclosure.

Referring to FIG. 8, a processor in the washing machine freezing prediction apparatus may further provide an execution query message 810 regarding a freeze protection function in the washing machine to a user terminal associated with the washing machine, together with freeze protection guidance information on the washing machine (for example, indicating that the washing machine is predicted to freeze tomorrow), when it is predicted that the washing machine will be frozen. The processor in the washing machine freezing prediction apparatus may, when the execution instruction regarding the freeze protection function is received from the user terminal (when a 'Yes' button 820 is selected), cause the washing machine to execute the freeze protection function, thereby preventing freezing of the washing machine.

Figure 9:
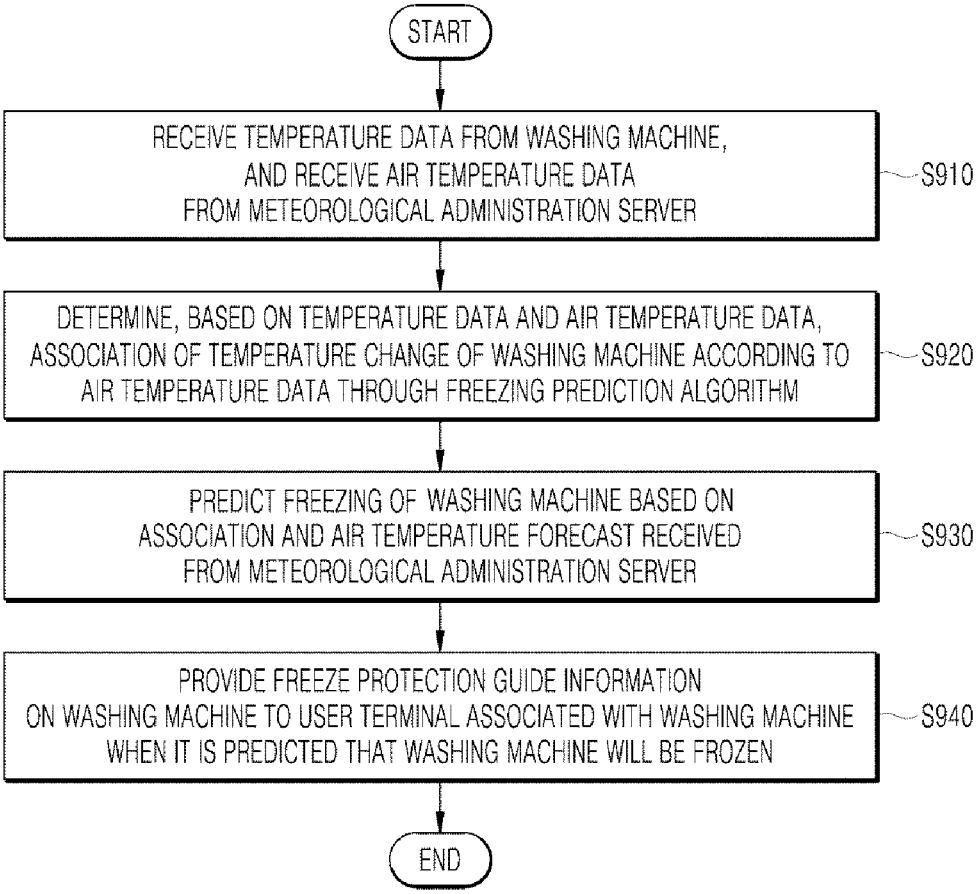
FIG. 9 is a flowchart illustrating a method for predicting freezing of a washing machine according to one embodiment of the present disclosure.

FIG. 9 is a flowchart illustrating a method for predicting freezing of a washing machine according to one embodiment of the present disclosure. Here, the washing machine freezing prediction apparatus implementing the washing machine freezing prediction method of the present disclosure may train the freezing prediction algorithm of the washing machine and store the trained freezing prediction algorithm in a memory. Here, the freezing prediction algorithm may be a neural network model that is trained to determine a group to which the washing machine belongs, based on air temperature information collected from a meteorological administration server and a temperature change of the washing machine according to the air temperature information. In this case, the neural network model may be trained to use, as training data, temperature data measured for a predetermined collection period of time in a washing machine in a freeze washing machine group in which freezing occurred within the collection period of time, the temperature data measured for the collection period of time in a washing machine in a non-freeze washing machine group in which freezing did not occur within the collection period of time, and the air temperature information collected from the meteorological administration server for the collection period of time, and determine whether the washing machine belongs to the freeze washing machine group or the non-freeze washing machine group, based on the temperature of the washing machine according to the air temperature information from the meteorological administration.

Referring to FIG. 9, in step S910, the washing machine freezing prediction apparatus may receive, from the washing machine, temperature data sensed by a temperature sensor disposed in the washing machine, and receive air temperature data from the meteorological administration server. In this case, the washing machine freezing prediction apparatus may receive, from the washing machine, temperature data sensed by a temperature sensor in the washing machine for a predetermined period of time (for example, one year or a period of use), and receive, from the meteorological administration server, air temperature data for the predetermined period of time. Here, the temperature data may be temperature data that is measured after the washing machine is powered on and before a washing operation starts, for the predetermined period of time after the washing machine is installed.

In step S920, the washing machine freezing prediction apparatus may determine, based on the received temperature data and air temperature data for the predetermined period of time, an association of temperature change of the washing machine according to the air temperature data through the freezing prediction algorithm. That is, the washing machine freezing prediction apparatus may apply the freezing prediction algorithm to the received temperature data and air temperature data for the predetermined period of time to determine the association.

In step S930, the washing machine freezing prediction apparatus may predict freezing of the washing machine based on the association of temperature change of the washing machine according to the air temperature data and an air temperature forecast received from the meteorological administration server (for example, the air temperature for one week from the present date). In this case, the washing machine freezing prediction apparatus may check whether a location of the washing machine is indoors or outdoors, based on the association of temperature change of the washing machine according to the air temperature data, and predict freezing of the washing machine when the washing machine is located outdoors as a result of the check.

When predicting freezing of the washing machine, the washing machine freezing prediction apparatus may apply the freezing prediction algorithm to the temperature data sensed by a temperature sensor disposed in the washing machine and the air temperature data received from the meteorological administration server, and determine a group to which the washing machine belongs, from among a freeze washing machine group or a non-freeze washing machine group. The washing machine freezing prediction apparatus may predict that the washing machine will be frozen when the determined group is the freeze washing machine group and when it is determined that the washing machine in the freeze washing machine group will be frozen, based on the air temperature forecast received from the meteorological administration server. Here, the washing machine freezing prediction apparatus may check whether there is a date in the air temperature forecast on which the air temperature is predicted to be equal to or less than a predetermined freezing temperature, and predict that the washing machine will be frozen when the date exists as a result of the check.

In step S940, the washing machine freezing prediction apparatus may, when it is predicted that the washing machine will be frozen, provide freeze protection guide information on the washing machine to a user terminal associated with the washing machine, thereby preventing freezing of the washing machine.

In this case, the washing machine freezing prediction apparatus may be configured to select, as a freezing prediction time of the washing machine, the date on which the air temperature is predicted to be equal to or less than the predetermined freezing temperature, and provide freeze protection guide information on the washing machine to the user terminal associated with the washing machine a predetermined period of time before the selected freezing prediction time.

Also, the washing machine freezing prediction apparatus may change the provision time of the freeze protection guide information on the washing machine, by adjusting the predetermined period of time based on usage information of the 'A' washing machine, when the usage information of the washing machine is received from the washing machine.

Meanwhile, in providing the freeze protection guide information, the washing machine freezing prediction apparatus may further provide an execution query message regarding a freeze protection function in the washing machine to the user terminal, together with the freeze protection guide information on the washing machine. In this case, the washing machine freezing prediction apparatus may, when an execution instruction regarding the freeze protection function is received from the user terminal, cause the washing machine to execute the freeze protection function, thereby preventing freezing of the washing machine.

Embodiments according to the present disclosure described above may be implemented in the form of computer programs that may be executed through various components on a computer, and such computer programs may be recorded in a computer-readable medium. In this case, examples of the computer-readable media may include, but are not limited to: magnetic media such as hard disks, floppy disks, and magnetic tape; optical media such as CD-ROM disks and DVD-ROM disks; magneto-optical media such as floptical disks; and hardware devices that are specially configured to store and execute program instructions, such as ROM, RAM, and flash memory devices.

Meanwhile, the computer programs may be those specially designed and constructed for the purposes of the present disclosure or they may be of the kind well known and available to those skilled in the computer software arts. Examples of computer programs may include both machine codes, such as produced by a compiler, and higher-level codes that may be executed by the computer using an interpreter or the like.

As used in the present disclosure (especially in the appended claims), the singular forms "a," "an," and "the" include both singular and plural references, unless the context clearly states otherwise. Also, it should be understood that any numerical range recited herein is intended to include all sub-ranges subsumed therein (unless expressly indicated otherwise) and therefore, the disclosed numeral ranges include every individual value between the minimum and maximum values of the numeral ranges.

The order of individual steps in process claims according to the present disclosure does not imply that the steps must be performed in this order; rather, the steps may be performed in any suitable order, unless expressly indicated otherwise. In other words, the present disclosure is not necessarily limited to the order in which the individual steps are recited. All examples described herein or the terms indicative thereof ("for example," "such as") used herein are merely to describe the present disclosure in greater detail. Therefore, it should be understood that the scope of the present disclosure is not limited to the example embodiments described above or by the use of such terms unless limited by the appended claims. Also, it should be apparent to those skilled in the art that various modifications, combinations, and alternations can be made depending on design conditions and factors within the scope of the appended claims or equivalents thereof.

The present disclosure is thus not limited to the example embodiments described above, and rather intended to include the following appended claims, and all modifications, equivalents, and alternatives falling within the spirit and scope of the following claims.

What is claimed is:

1. An apparatus for predicting freezing of a washing machine according to a change of air temperature, comprising:

a memory in which a freezing prediction algorithm of the washing machine is stored; and one or more processors in communication with the memory, the one or more processors being configured to:

determine, based on temperature data sensed by a temperature sensor disposed in the washing machine and air temperature data received from a server, an association of temperature change of the washing machine according to the air temperature data through the freezing prediction algorithm; and predict freezing of the washing machine based on the association of temperature change of the washing machine and an air temperature forecast received from the server, wherein the one or more processors are configured to determine whether a location of the washing machine is indoors or outdoors, based on the association of temperature change of the washing machine, and wherein the predicting of the freezing of the washing machine occurs when the washing machine is determined to be located outdoors.

2. The apparatus of claim 1, wherein the temperature data is measured after the washing machine is powered on and before a washing operation starts for a predetermined period of time.

3. The apparatus of claim 1, wherein the one or more processors are further configured to:

receive, from the washing machine, the temperature data for a predetermined period of time;

receive, from the server, the air temperature data for the predetermined period of time; and apply the freezing prediction algorithm to the received temperature data and air temperature data for the predetermined period of time to determine the association of temperature change of the washing machine.

4. An apparatus for predicting freezing of a washing machine according to a change of air temperature, comprising:

a memory in which a freezing prediction algorithm of the washing machine is stored; and one or more processors in communication with the memory, the one or more processors being configured to:

determine, based on temperature data sensed by a temperature sensor disposed in the washing machine and air temperature data received from a server, an association of temperature change of the washing machine according to the air temperature data through the freezing prediction algorithm; and predict freezing of the washing machine based on the association of temperature change of the washing machine and an air temperature forecast received from the server, wherein the freezing prediction algorithm is a neural network model that is trained to determine a group to which the washing machine belongs, based on the air temperature data collected from the server and the temperature change of the washing machine according to the air temperature data, wherein the group is one of a freeze washing machine group in which freezing occurred within a predetermined collection period of time and a non-freeze washing machine group in which freezing did not occur within the predetermined collection period of time, and wherein the neural network model is trained to use, as training data, temperature data measured for the predetermined collection period of time in another washing machine of a freeze washing machine group in which freezing occurred within the predetermined collection period of time, temperature data measured for the predetermined collection period of time in another washing machine of a non-freeze washing machine group in which freezing did not occur within the predetermined collection period of time, and air temperature information collected from the server for the predetermined collection period of time, and to determine whether the washing machine belongs to the freeze washing machine group or the non-freeze washing machine group based on the training data.

5. An apparatus for predicting freezing of a washing machine according to a change of air temperature, comprising:

a memory in which a freezing prediction algorithm of the washing machine is stored; and one or more processors in communication with the memory, the one or more processors being configured to:

determine, based on temperature data sensed by a temperature sensor disposed in the washing machine and air temperature data received from a server, an association of temperature change of the washing machine according to the air temperature data through the freezing prediction algorithm; and predict freezing of the washing machine based on the association of temperature change of the washing machine and an air temperature forecast received from the server, wherein the one or more processors are further configured to:

apply the freezing prediction algorithm to the temperature data and the air temperature data;

determine a group to which the washing machine belongs, from among a freeze washing machine group or a non-freeze washing machine group based on the air temperature forecast; and predict when the washing machine will be frozen when the determined group is the freeze washing machine group.

6. The apparatus of claim 5, wherein the one or more processors are further configured to provide a freeze protection guide information of the washing machine to a user terminal associated with the washing machine when the prediction of when the washing machine will be frozen occurs.

7. The apparatus of claim 6, wherein the one or more processors are further configured to:

further provide an execution query message regarding a freeze protection function in the washing machine to the user terminal, together with the freeze protection guide information of the washing machine; and cause the washing machine to execute the freeze protection function when an execution instruction regarding the freeze protection function is received from the user terminal.

8. The apparatus of claim 5, wherein the one or more processors are further configured to:

determine whether there is a date in the air temperature forecast on which the air temperature is predicted to be equal to or less than a predetermined freezing temperature; and predict that the washing machine will be frozen when the date is determined.

9. The apparatus of claim 8, wherein the one or more processors are further configured to:

select, as a freezing prediction time of the washing machine, the date on which the air temperature is predicted to be equal to or less than the predetermined freezing temperature, when the predication of when the machine will be frozen occurs; and provide a freeze protection guide information on the washing machine to the user terminal associated with the washing machine a predetermined period of time before the selected freezing prediction time.

10. The apparatus of claim 8, wherein the one or more processors are further configured to:

provide a freeze protection guide information of the washing machine to a user terminal associated with the washing machine a predetermined time before the freezing prediction time of the washing machine at which freezing of the washing machine is predicted, and when usage information of the washing machine is determined from the washing machine, change a provision time of the freeze protection guide information on the washing machine by adjusting the predetermined time based on the usage information of the washing machine.

11. A method for predicting freezing of a washing machine according to change of air temperature, comprising:

storing a freezing prediction algorithm of the washing machine in a memory;

receiving, from the washing machine, temperature data sensed by a temperature sensor disposed in the washing machine;

receiving air temperature data from a server;

determining, based on the received temperature data and the received air temperature data, an association of temperature change of the washing machine according to the air temperature data through the freezing prediction algorithm; and predicting freezing of the washing machine based on the association of temperature change of the washing machine and an air temperature forecast received from the server, wherein the predicting freezing of the washing machine comprises:

determining whether a location of the washing machine is indoors or outdoors, based on the association of temperature change of the washing machine; and predicting freezing of the washing machine when the washing machine is located outdoors.

12. The method of claim 11, wherein the temperature data is measured after the washing machine is powered on and before a washing operation starts for a predetermined period of time.

13. The method of claim 11, wherein the freezing prediction algorithm is a neural network model that is trained to determine a group to which the washing machine belongs, based on the air temperature data collected from the server and the temperature change of the washing machine according to the air temperature data, wherein the group is one of a freeze washing machine group in which freezing occurred within a predetermined collection period of time and a non-freeze washing machine group in which freezing did not occur within the predetermined collection period of time, and wherein the neural network model is trained to use, as training data, temperature data measured for a predetermined collection period of time in another washing machine of a freeze washing machine group in which freezing occurred within the predetermined collection period of time, temperature data measured for the predetermined collection period of time in another washing machine of a non-freeze washing machine group in which freezing did not occur within the predetermined collection period of time, and air temperature information collected from the server for the predetermined collection period of time, and to determine whether the washing machine belongs to the freeze washing machine group or the non-freeze washing machine group based on the training data.

14. The method of claim 11, wherein the determining the association of temperature change of the washing machine comprises:

receiving, from the washing machine, the temperature data for a predetermined period of time;

receiving, from the server, the air temperature data for the predetermined period of time; and applying the freezing prediction algorithm to the received temperature data and air temperature data for the predetermined period of time to determine the association of temperature change of the washing machine.

15. The method of claim 11, wherein the predicting freezing of the washing machine comprises:

applying the freezing prediction algorithm to the temperature data and the air temperature data;

determining a group to which the washing machine belongs, from among a freeze washing machine group or a non-freeze washing machine group, based on the air temperature forecast; and predicting when the washing machine will be frozen when the determined group is the freeze washing machine group.

16. The method of claim 15, further comprising, after the predicting freezing of the washing machine, providing a freeze protection guide information of the washing machine to a user terminal associated with the washing machine when the prediction of when the washing machine will be frozen occurs.

17. The method of claim 15, wherein the predicting that the washing machine will be frozen comprises determining whether there is a date in the air temperature forecast on which the air temperature is predicted to be equal to or less than a predetermined freezing temperature, and predicting that the washing machine will be frozen when the date is determined.

18. The method of claim 17, further comprising, after the predicting freezing of the washing machine:

selecting, as a freezing prediction time of the washing machine, the date on which the air temperature is predicted to be equal to or less than the predetermined freezing temperature, when it is predicted that the washing machine will be frozen; and providing a freeze protection guide information of the washing machine to the user terminal associated with the washing machine a predetermined period of time before the selected freezing prediction time.

* * * * *